United States Patent [19]

Vandeweghe

[11] 4,032,991

[45] July 5, 1977

[54] FACE AND HEAD PROTECTIVE DEVICE

[75] Inventor: Joseph L. Vandeweghe, Englewood, N.J.

[73] Assignee: Engleway Corporation, Englewood, N.J.

[22] Filed: Jan. 5, 1976

[21] Appl. No.: 646,505

[52] U.S. Cl. ..... 2/173; 2/206; 128/142.7

[51] Int. Cl.[2] ..... A42B 1/18

[58] Field of Search ..... 2/173, 199, 5, 195, 2/9, 206, 205, 202, 174, 198, 196; 128/141 R, 142.7, 146.2

[56] References Cited

UNITED STATES PATENTS

| | | | |
|---|---|---|---|
| 152,215 | 6/1874 | Crofutt | 128/141 R |
| 2,122,171 | 6/1938 | Alexander | 2/196 |
| 2,546,117 | 3/1951 | Whelan | 2/174 |
| 2,998,611 | 9/1961 | Schuessler | 2/202 |
| 3,314,079 | 4/1967 | Stout et al. | 2/173 |
| 3,521,629 | 7/1970 | Reynolds | 128/142.7 |

*Primary Examiner*—Werner H. Schroeder
*Assistant Examiner*—Peter Nerbun
*Attorney, Agent, or Firm*—Bernard Malina

[57] ABSTRACT

A fire, smoke and noxious fumes protective device comprises an air-tight envelope made of fire-resistant transparent sheet plastic material and encloses a pre-moistened porous face mask secured thereto. The device is rendered into the operative condition by opening the envelope which converts to a head cap for covering head and eyes of the wearer and extending the face mask out of the envelope whereby the mask extends downwardly from the cap over the nose and mouth of the wearer to afford protection against smoke and noxious fume inhalation.

8 Claims, 6 Drawing Figures

FACE AND HEAD PROTECTIVE DEVICE

BACKGROUND OF THE INVENTION

The present invention relates to fire and smoke protective devices and more particularly to a protective face and head mask providing protection against fire and smoke inhalation in the event of a fire condition.

The various types of apparatus presently used to provide protection to victims of fire, smoke, noxious fumes and similar emergency conditions, such as gas masks, oxygen masks and the like, are usually unavailable to building occupants, and certainly no all of them, when they are trapped in a building. Such conventional protective apparatus is clearly too expensive, too cumbersome to store and too complicated for the untrained person to use under emergency conditions when the building occupants suddenly find themselves under severe emotional stress. Furthermore, even if such known protective equipment could be made available to the building occupants, because of the relatively complicatd construction and mechanical operation thereof, such equipment would have to be periodially checked and maintained to ensure reliable operation thereof when needed. Of course, such conventional protective apparatus is so expensive and cumbersome so as to effectively rule out its use on a mass basis by building occupants.

It is therefore an object of the present invention to provide a single use protective device operative to provide the wearer with protection against fire, smoke and noxious fume inhalation.

It is a further object to provide a protective device of the character described which is very economical to manufacture, and compact in its storage and operative conditions respectively.

It is yet another object of the present invention to provide a protective device of the character described which requires no maintenance in its storage condition and which can be simply and quickly rendered from its storage into its operative condition.

SUMMARY OF THE INVENTION

In accordance with the principles of the present invention, there is provided a protective device operative to be rendered from a storage condition into an operative condition to afford protection to the wearer against the deleterious effects of fire, smoke, and noxious fumes inhalation. The device in the storage condition comprises an envelope portion made of transparent fire-resistant sheet material having an envelope portion enclosing a porous face mask portion secured thereto and an openable air-tight aperture to permit access to and extension of said face mask from said envelope portion to render said device into the operative condition.

Further objects, features and advantages of this invention will become apparent from a consideration of the following description, the appended claims, and the accompanying drawings, in which:

DETAILED DESCRIPTION OF THE INVENTION

Figure 1:
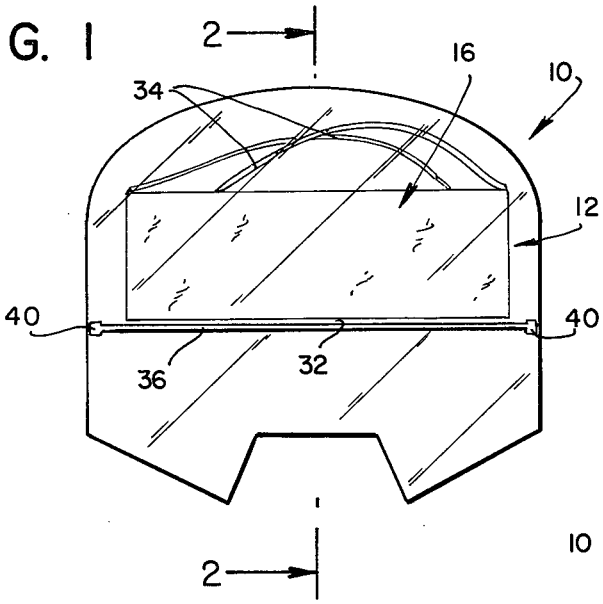
FIG. 1 is a plan vie of a protective device in accordance with the present invention shown in the storage condition with the mask portion folded into its integral transparent air-tight envelope.
Figure 3:
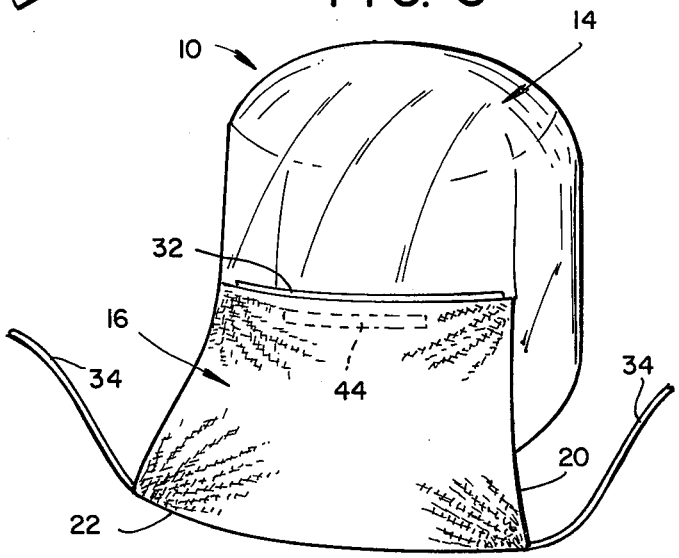
FIG. 3 is a front perspective view of the protective device of FIG. 1 in the open condition ready for wear, showing the envelope portion in its opened condition for wear as a protective cap.
Figure 2:
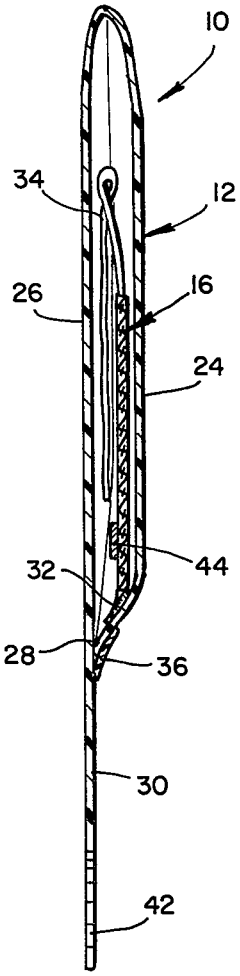
FIG. 2 is a section view taken along the line 2—2 of FIG. 1.

Referring to the drawings, and in particular to FIGS. 1–3 thereof, a protective device in accordance with the principles of the present invention is generally designated by the numeral 10. Protective device 10 comprises an envelope portion 12, which is convertible into a protective cap 14 as hereinafter described enclosing a folded face mask 16 and maintained air-tight by means of a single-use sealing strip 36.

Envelope 12 is made of transparent, fire and heat resistant sheet material such as tetrafluorocarbon (FEP) having a thickness typically in the range of 0.5–20 thousandths of an inch. Face mask 16 comprises a plurality of rectangular plies 17 of woven fabric which may be suitably seamed together along the side and bottom edges 20 and 22. Each of the plies are suitably perforated and arranged so that the perforations will be appropriately offset from each other when the plies are seamed whereby face mask 16 will be operative to filter smoke particles yet permit the wearer to breathe easily therethrough. Face mask 16 may, alternately, comprise foam or other porous material suitable for filtering smoke particles, noxious fumes and the like.

In the storage condition of device 10, envelope 12 comprises front and rear panels 24 and 26 and includes an elongated narrow aperture 28 extending almost the entire width of envelope front panel 24. Front and rear panels 24 and 26 merge at their bottom edges into a base strip 30 with aperture 28 closely adjacent to the top end of base strip 30.

The top edge 32 of face mask 16 is suitably seamed or otherwise secured to the inside surface of front panel 24 adjacent, parallel to and substantially coextensive with aperture 28. A pair of draw string 34 are respectively secured at one end thereof the opposite free end corners of face mask 16.

As shown in FIG. 2, face mask 16 may suitably be folded in half whereby device 10 in its storage position shown in FIGS. 1 and 2 presents a substantially flat package.

In its stored condition, face mask 16 may advantageously be moistened with water or other fluid suitable for trapping smoke particles and cooling the air passing therethrough to the nose and mouth of the wearer in the event of fire or other condition of smoke or noxious fumes. In order to provide further smoke and noxious fume flitering capability, mask 16 may have granulated carbon particles 19 or other filtering agents disposed between the fabric plies which make up mask 16. Envelope 12 is further provided with a single-use sealing strip 36 which is air-tight sealed over apertuer 28 to maintain face mask 16 in the moistened condition during the stored condition of device. Sealing strip 36 may advantageously be provided with a pair of tear tabs 40 so that the user may easily tear away sealing strip 36 thus opening aperture 28 to permit face mask 16 to be pulled therethrogh and envelope portion 12 unfolded into the operative condition shown in FIG. 3 providing a cap 14.

When not in use, protective device 10 may be conventiently stored in the storage condition shown in FIGS. 1 and 2 in a desk drawer or other appropriate location. In the event of fire, smoke or noxious fumes, the user may quickly and easily render protective device 10 into its operative condition in the following manner. He merely pulls at either of tear tabs 40 to tear away sealing strip 36 thus opening aperture 28 and reaches through aperture 28 to the interior of envelope 12 to pull face mask 16 through aperture 28. the user may, if necessary, open envelope portion 12 to render it into cap 14, whereby it assumes a substantially cylindrical shape as shown in FIG. 3

Figure 5:
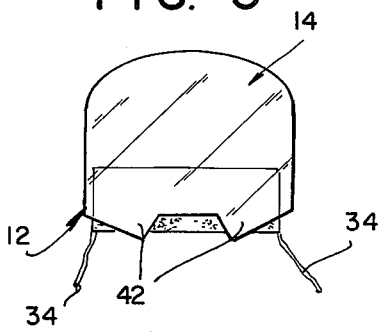
FIG. 5 is a rear view of the protective device in the condition shown in FIG. 4.
Figure 4:
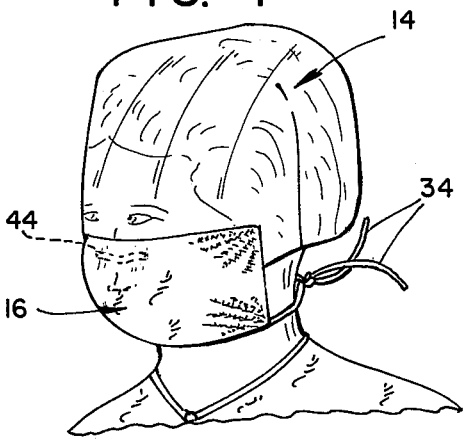
FIG. 4 is a front perspective view similar to that of FIG. 2 but showing the protective device being worn in the operative condition.
Figure 6:
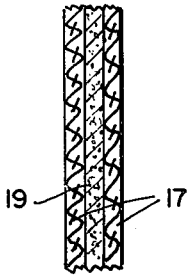
FIG. 6 is a section view through the multi-ply mask portion of the protective device of FIGS. 2 and 3.

The user then places cap 14 over his head, as shown in FIG. 4, with face mask 16 hanging down from the lower edge of front panel 32 adjacent aperture 28. Face mask 16 and front panel 32 are suitably dimensioned so that when protective device 10 is placed over the wearer's head, as shown in FIG. 4, the wearer's eyes and ears are positioned behind transparent front panel 24 slightly above aperture 28 while mask 16 covers the nose and mouth of the wearer to permit breathing therethrough. At the same time the base strip 30 of rear panel 26 encircles the rear of the wearer's neck to ensure that the wearer's hair is substantially covered to protect the same from being burned by fire. The wearer then draws strip 34 behind his neck, tucking face mask 16 under his chin, as shown in FIG. 4 and ties the ends of strip 34 over the rear flaps 42 which may be provided at base strip 30, as shown in FIG. 5 to ensure a close fitting of protective device 10 over the head and neck of the wearer.

Face mask 16 may also be provided with bendable plastic or metal tab 44 which may be located between adjacent fabric plies of mask 16 and which may be adjusted by the wearer to have tab 44 seat on the bridge of his nose to ensure a secure and close fit of mask 16 over the wearer's face and to prevent fogging of front panel 24 over the eyes which may otherwise be caused by the wearer's breath.

Thus, in the operative condition of protective device 10 shown in FIG. 4, the cap 14 protects the wearer's eyes, head, ears and hair against the effects of fire and smoke while mask 16 protects his respiratory system against the effects of smoke and noxious fume inhalation. As a result, the user's prospects for safely navigating his way through an area of fire, smoke and/or noxious fumes is greatly enhanced without the necessity of reliance on gas mask, oxygen supply tank, goggles or other equipment which is cumbersome, expensive and usually unavailable to the victim of an emergency such as fire, smoke or noxious fumes.

Furthermore, since the protective device 10 is economical to manufacture, compact to store, and simple to use, it may be distributed to all occupants of a building with the expectation that it will be employed by all such occupants in the event of a fire, smoke, noxious fumes or similar emergency to facilitate safe escape from the building.

Although the invention has been described with reference to particular embodiments thereof, it is to be understood that such embodiments are merely illustrative of the application of the principles of the invention. Numerous modifications may be made therein and other arrangements may be devised without departing from the spirit and scope of the invention.

What is claimed is:

1. A protective device operative to be rendered from a storage condition into an operative condition to afford protection to the wearer against the effects of fire, smoke and noxious fume inhalation; said device in the storage condition comprising; a water-proof envelope enclosing a moistened porous face mask secured thereto, said envelope including an aperture and air-tight closure means operative to air-tight seal said aperture to thereby maintain said face mask in its moistened condition when said device is in said storage condition, whereby removal of said closure means permits access to and withdrawal of said face mask from the interior of said envelope to render said device into the operative condition wherein said envelope is adaptable to be rendered into a head cap.

2. A protective device as defined in claim 1 wherein said device in the operative condition comprises said cap and said face mask depending downwardly from the front bottom edge of said cap.

3. A protective device as defined in claim 1 wherein said device in the operative condition seated on the head of the wearer, the front side of said cap comprises transparent material suitably dimensioned so that said transparent material covers the wearer's eyes and permits the wearer to see therethrough.

4. A protective device as defined in claim 3 wherein said face mask extends downwardly from the bottom end of said transparent material and is suitably dimensioned so as to cover the wearer's nose and mouth.

5. A protective device as defined in claim 4 wherein said face mask comprises porous material operative to filter smoke particles.

6. A protective device as defined in claim 5, wherein said cap comprises fire-resistant flexible plastic sheet material.

7. A protective device as defined in claim 6 wherein said face mask includes a pair of draw strings respectively secured to the bottom corners of the free end of said face mask to permit said face mask to be drawn closely over the nose and mouth of the wearer and tied behind the wearer's head.

8. A protective device as defined in claim 5 wherein said face mask comprises porous material operative to filter noxious fumes.

* * * * *